US005957724A

United States Patent [19]

Lester

[11] Patent Number: 5,957,724

[45] Date of Patent: Sep. 28, 1999

[54] COAX PLUG INSULATOR

[75] Inventor: Lester Joaquin Lester, Signal Hill, Calif.

[73] Assignee: ITT Manufacturing Enterprises, Inc., Wilmington, Del.

[21] Appl. No.: 08/854,737

[22] Filed: May 12, 1997

[51] Int. Cl.[6] ..... H01R 9/05

[52] U.S. Cl. ..... 439/578; 439/675; 333/260

[58] Field of Search ..... 439/578, 675; 333/260, 244

[56] References Cited

U.S. PATENT DOCUMENTS

| | | | |
|---|---|---|---|
| 4,035,054 | 7/1977 | Lattanzi | 439/578 |
| 4,456,324 | 6/1984 | Staeger | 439/578 |
| 4,824,399 | 4/1989 | Bogar et al. | 439/578 |
| 4,867,703 | 9/1989 | Flanagan et al. | 439/578 |
| 4,981,445 | 1/1991 | Bacher et al. | 439/578 |
| 5,041,020 | 8/1991 | Michael | 439/578 |
| 5,100,344 | 3/1992 | Truong | 439/578 |
| 5,167,532 | 12/1992 | Bruno et al. | 439/578 |
| 5,516,307 | 5/1996 | Cartesse et al. | 439/581 |
| 5,645,454 | 7/1997 | Kosmala | 439/675 |

*Primary Examiner*—Steven L. Stephan
*Assistant Examiner*—T C Patel
*Attorney, Agent, or Firm*—Thomas L. Peterson

[57] ABSTRACT

A coaxial connector is provided, of a type that has a front portion (12) where the inner conductor (14) forms a socket for receiving a pin (M) of predetermined diameter (A) (1 mm) and the outer conductor has a front end of predetermined outside diameter (B) (3.7 mm), which enables an increase in characteristic impedance at the front portion of the connector to more closely match the impedance of the middle portion (16) of the connector. A dielectric support (30) that positions the inner conductor within the over one, includes primarily air at the front portion, to increase the characteristic impedance of the front portion without changing its diameter. The insulative support preferably includes a middle portion (72) with ring-shaped locating portions (62, 64) that are closely received in the outer conductor, that closely surround the inner conductor, and that abut shoulders on the inner conductor to fix the position of the inner conductor in radial and axial directions. The support also includes a front portion (66) with a ring-shaped locating portion (56) that is closely received within the front end (60) of the outer conductor but which does not engage the inner conductor and that forms a lead-in (58), and with posts (66) extending axially from the front ring to the middle portion of the support.

8 Claims, 3 Drawing Sheets

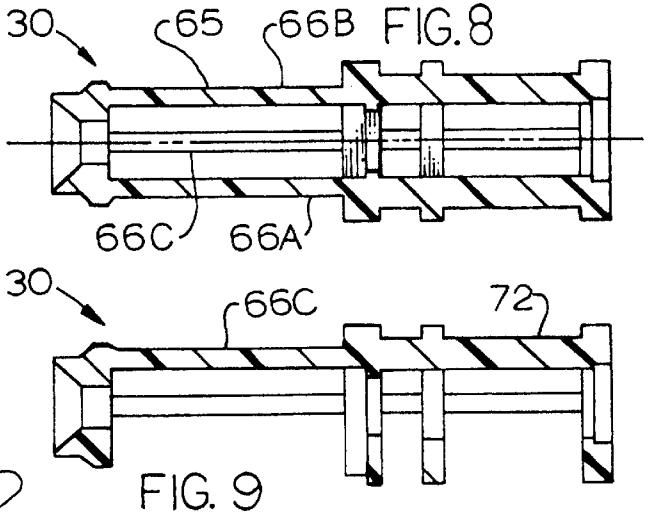
FIG. 8
FIG. 9
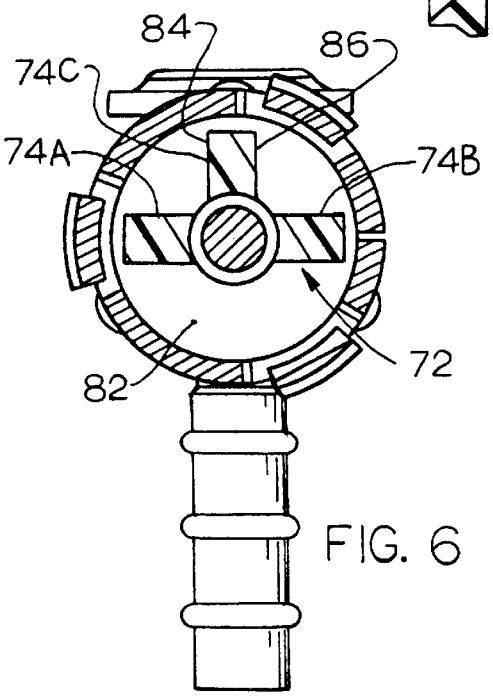
FIG. 6
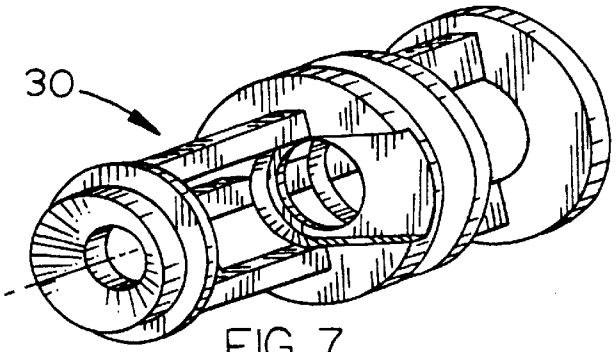
FIG. 7
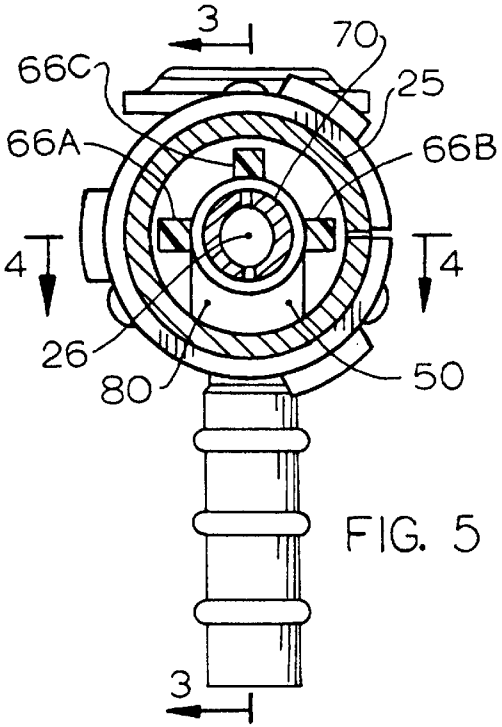
FIG. 5

COAX PLUG INSULATOR

BACKGROUND OF THE INVENTION

Coaxial connectors include inner and outer conductors and an insulator, or dielectric, lying between them. Such connectors typically are designated to have a predetermined characteristic impedance, which is usually 50 ohms, and sometimes 75 ohms to match the impedance of a cable and mating connector so as to minimize the standing wave ratio and consequent losses. A widely used and largely standard miniature plug coaxial connector has a front end where the inner conductor forms a socket for receiving a pin of 1 mm diameters and where the outer conductor has an outer diameter of 3.7 mm to engage the outer conductor of the mating connector. A dielectric material such as Teflon occupies substantially all of the space between the inner and outer conductors. The connector middle portion has a larger outer conductor diameter, and can have virtually any inner conductor diameter (since that inner conductor portion does not have to receive a pin) to achieve the desired impedance.

At thee front portion of the above prior standard plug connector, the inner conductor has a diameter of 1.4 mm, and the outer conductor has an inside diameter of about 3 mm, with the space between them filled with Teflon which has a dielectric constant of 2.55. The result is that the front portion of the connector has a characteristic impedance of 28 ohms. With the connector front portion having a characteristic impedance of 28 ohms, there is a serious mismatch with the characteristic impedance of the connector middle portion which has an impedance of 50 or 75 ohms. As a result, the prior connector gave rise to a considerable VSWR (voltage standing wave ratio) of about 1.13 to about 1.15, resulting in considerable losses. Although this mismatch and the resulting losses were known, no steps were taken to reduce the mismatch of characteristic impedances.

It is noted that a variety of dielectric materials are available for use in coaxial connectors, with Teflon (dielectric constant of 2.55) being the most common because of its relatively low losses especially at higher frequencies (on the order 1 GHz and higher). For example, U.S. Pat. No. 5,100,344 by Truong shows a coaxial connector plug where the front portion has an even larger inside diameter than the rear portion so mismatch would not be a problem with only a solid dielectric, although the patent describes using primarily air as the dielectric. U.S. Pat. No. 4,981,445 by Bacher et al describes a coaxial plug where the rear portion has about 50% air and 50% of a solid dielectric and the front portion is not surrounded by an outer conductor. Neither of these patents show a plug coaxial connector where there is a reduced diameter front end that results in a lower impedance than the rear portion or describes how to correct this problem.

SUMMARY OF THE INVENTION

In accordance with one embodiment of the present invention, a coaxial connector is provided, of a type which has a reduced diameter front portion, and especially where the front portion has a socket inner conductor for receiving a pin of a 1 mm diameter and the outer conductor outer diameter is about 3.7 mm, which enables an increase in the characteristic impedance of the front portion to more closely match the characteristic impedance of the middle (rear) portion. The space between the inner and outer conductors at the reduced diameter front portion, is filled primarily with air, to increase the characteristic impedance of the front portion without reducing the diameter of the inner conductor thereat or increasing the diameter of the outer conductor thereat.

A support molded of solid dielectric material lies in the space between the inner and outer conductors and positions the inner conductor so it lies on the axis of the connector and is prevented from moving axially. A pair of ring-shaped location parts includes a mid location part that closely surrounds the inner conductor immediately rearward of its socket and which is closely surrounded by the outer conductor, and a rear location part that closely surrounds the inner conductor and is closely surrounded by the outer conductor. Rods extending parallel to the connector axis connect the mid and rear location parts. The rods preferably do not closely surround the inner conductor and are not closely surrounded by the outer conductor, so they do not radially locate the inner conductor but merely space the ring-shaped location part. A ring-shaped front location part which forms a lead-in lies closely within the front end of the outer conductor but is spaced from the inner conductor. The front location part is connected by rods to the mid location part.

The novel features of the invention are set forth with particularity in the appended claims. The invention will be best understood from the following description when read in conjunction with the accompanying drawings.

BRIEF DESCRIPTION OF THE DRAWINGS

FIG. 5 is a sectional view of the connector of FIG. 1 taken on line 5—5 thereof.

FIG. 6 is a view taken on line 6—6 of FIG. 1.

FIG. 7 is an isometric view of the support of the connector of FIGS. 1–6.

FIG. 8 is a sectional side view of the support as shown in FIG. 4.

FIG. 9 is a sectional view of the support as shown in FIG. 3.

DESCRIPTION OF THE PREFERRED EMBODIMENT

Figure 1:
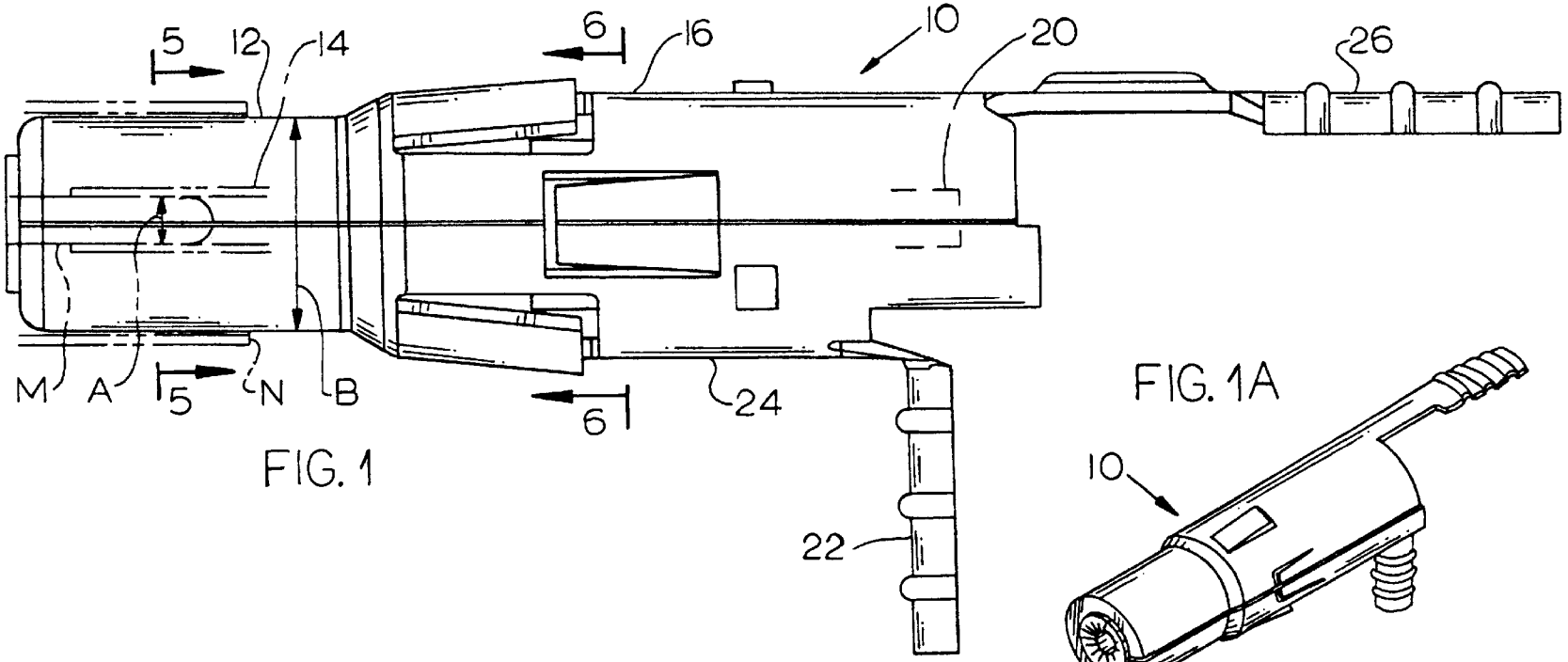
FIG. 1 is a side elevation view of a plug coaxial connector constructed in accordance with the present invention.
Figure 1A:
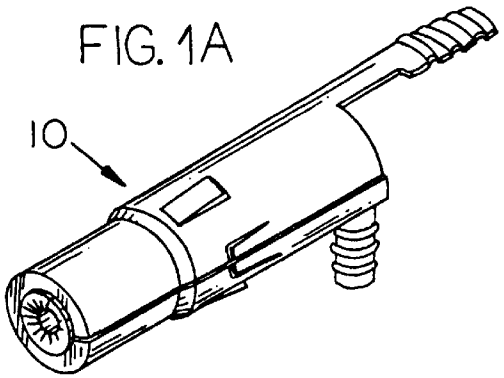
FIG. 1A is an isometric view of the coaxial connector of FIG. 1.
Figure 2:
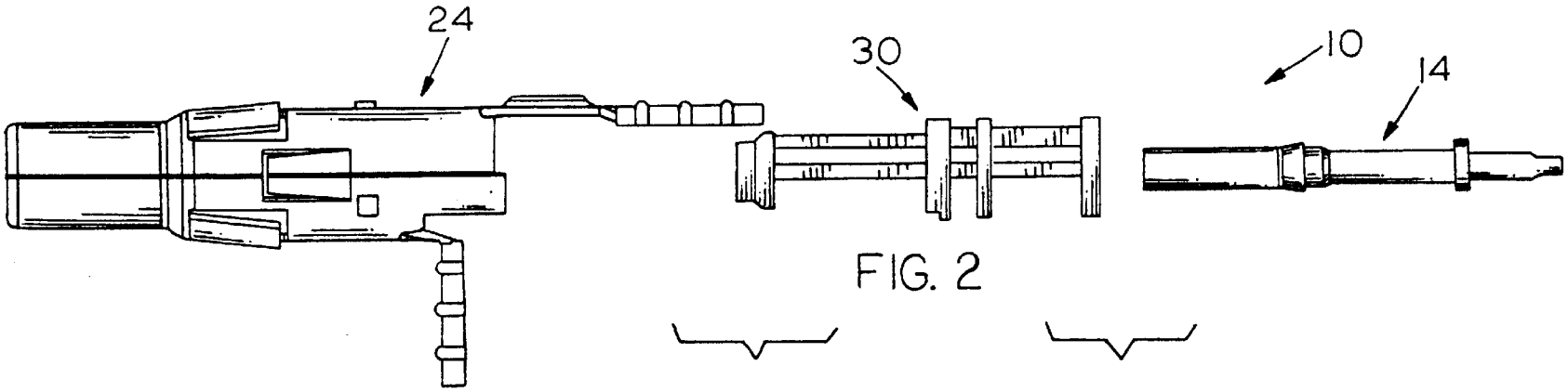
FIG. 2 is an exploded side elevation view of the coaxial connector of FIG. 1.

FIG. 1 illustrates a type of miniature plug coaxial connector 10 that is in common use and sold in large numbers by applicant which is of a "standard" size. That is, the connector has a front portion 12 and has an inner coaxial conductor 14 with a front portion that is designed to receive a pin M of a diameter A of 1 mm. Also, the front portion is designed to mate with an outer conductor N of the mating connector, which is accomplished where the outer diameter B of the front portion is about 3.7 mm. The connector 10 has a middle or rear portion 16 whose outer diameter is not specified (it does not mate with the other connector). A coaxial cable is assembled to the connector by engaging a center conductor of the cable to the rear end 20 of the inner conductor and engaging the cable outer conductor to an extension 22 of the shell or outer conductor 24 of the connector. It is noted that after most of the connection is made, another extension 26 of the shell is bent downwardly against the extension 22.

Figure 3:
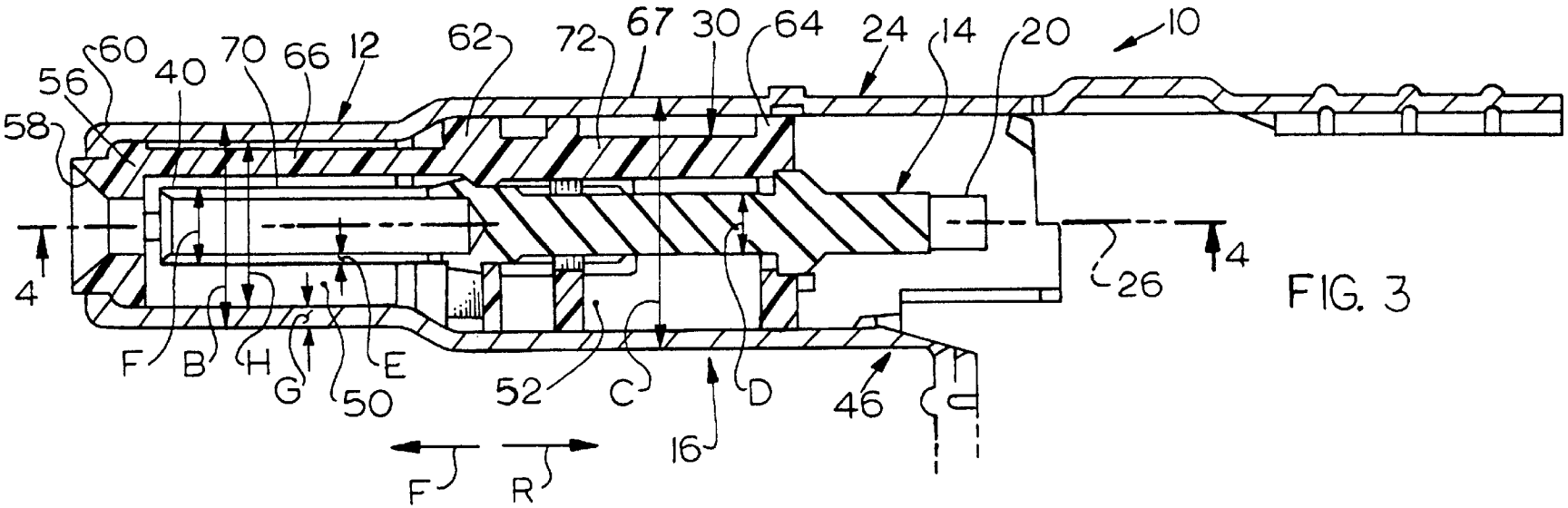
FIG. 3 is a sectional view of the coaxial connector of FIG. 1, taken on line 3—3 of FIG. 5.
Figure 4:
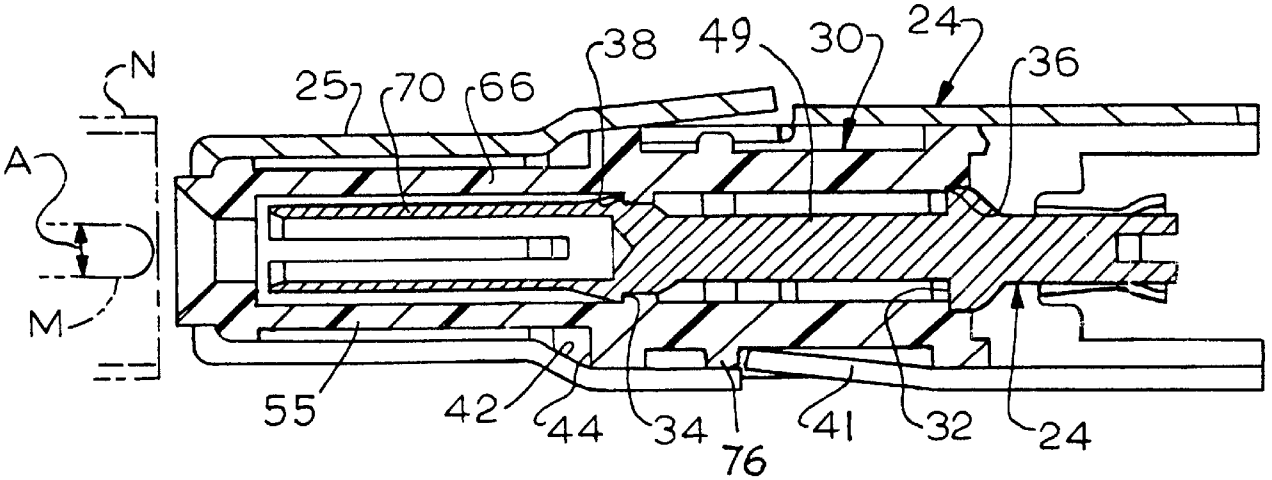
FIG. 4 is a sectional view of the coaxial connector of FIG. 3, taken on line 4—4 of FIG. 3 and of FIG. 5.

As shown in FIGS. 3 and 4, the inner conductor 14 lies concentric with the shell-shaped outer conductor 24 along a connector axis 26. A dielectric support 30 positions the coaxial conductors so they remain concentric, and prevents front or rear F, R movement of the inner conductor with respect to the outer one. The inner conductor 14 has forwardly and rearwardly facing shoulders 32, 34, and the support 30 has corresponding shoulders 36, 38 to prevent axial movement of the inner conductor. The outer conductor has tabs 41 that prevent rearward movement of the insulator and has a shoulder 42 that abuts a surface 44 of the insulator to prevent its forward movement. The connector part 46 which lies rearward of the support (where it engages inner conductor shoulder 32) is considered to be the rear portion of the connector in the following discussion.

Coaxial cables and connectors are usually designed to have a predetermined characteristic impedance, with the most common probably being 50 ohms and next most common being 75 ohms. To minimize the VSWR (voltage standing wave ratio) and consequent losses, it is desirable to construct the connector so it has a characteristic impedance as close as possible to that of the other components of the circuit; i.e. to make the connector so it has a characteristic impedance of 50 ohms or 75 ohms throughout. The middle portion 16 which generally has an outer diameter C of 4.6 mm (more than 4.1 mm), can be easily sized to create a desired impedance (as can the rear portion). Generally, the diameter D of the inner conductor middle portion is adjusted so that with the particular dielectric lying between the inner and outer conductors thereat, the desired characteristic impedance (50 or 75 ohms) is achieved. However, previously it has not been possible for the connector designer to construct the connector front portion 12 so it had an impedance close to the desired level, such as 50 ohms.

As discussed above, the front portion 40 of the inner conductor had to receive a pin M of 1 mm diameter. The inner conductor front portion 40 was divided into two tines 70, each having a thickness E such as 0.008 inch (0.2 mm), resulting in an outside diameter J of about 1.4 mm. Since the outer diameter B of the connector front portion was about 3.7 mm (less than 3.9 mm) and the thickness G of the shell walls was about 0.014 inch (0.35 mm) the inside diameter H of the shell was about 3 mm. When Teflon (dielectric constant of 2.55) filled the space between the inner and outer conductors at the front portion 12 of the connector, the characteristic impedance of the front portion was about 28 ohms. A characteristic impedance of 28 ohms for the connector front portion, when used with a circuit and connector middle portion of 50 ohms, resulted in a large VSWR and corresponding losses. Although connector designers were aware of this difference in characteristic impedance and the consequent losses, designers previously were not able to rectify the situation.

In accordance with the present invention, applicant significantly raises the characteristic impedance of the plug connector front portion 12 from 28 ohms to 45 ohms to achieve a much closer match to the characteristic impedance of the rear portion 16 of the connector and to the characteristic impedance of circuitry including the cable and mating connector) that is electrically connected to the plug connector. Applicant accomplishes this by constructing the dielectric support 30 so there is a minimum of solid dielectric material in the front portion 50 of the space 52 between the inner and outer conductors. That is, solid material occupies less one-third of the front space portion 50. Although applicant could make the front space portion 50 completely devoid of insulation, applicant prefers to provide a front ring portion or front locator part 56 which forms a lead-in at 58. The front locator part 56 is closely surrounded by the front 60 of the outer conductor, but preferably does not closely surround the deflectable tines 70 of the inner conductor. The dielectric support also includes mid and rear ring-shaped locating parts 62, 64 that are each closely surrounded by the outer conductor 24, and that each closely surrounds the inner conductor 14. The mid locating part 62 lies at the rear of the inner conductor front portion to avoid interference with the tines 70. Each of the locating parts comprises a ring that extends substantially 360° (more than 320°) around the axis. It is noted that the locating portions 62, 64 form the shoulders 32, 34 that fix the axial position of the inner conductor.

Applicant connects the front locating part 56 to the middle locating part 62 by a front dielectric portion 65 largely formed by plurality of axially-extending rods 66. As shown in FIG. 5, there are three rods 66A, 66B, and 66C that are circumferentially spaced about the connector axis 26. The rods do not closely surround the inner conductor at its tines 70, and are not closely surrounded by the front portion 25 of the outer conductor 24. The purpose of the rods is to axially position the front locating portion rather than to radially position anything (with respect to axis 26). As shown in FIG. 5, the three rods occupy only about 20% of the cross-sectional area of the connector front portion. Air occupies the rest. As a result, the characteristic impedance of the front portion is close to the level that would be achieved by providing only air in the front portion space 50. As mentioned above, this construction results in the front portion having a characteristic impedance of 45 ohms, which is close to the level of 50 ohms of the rear portion and of the most common specified level for the connector.

The characteristic impedance I of a coaxial connector section is equal to:

$$I=138/\sqrt{e}\times\mathrm{Log}_{10}D/d$$

where D is the inside diameter of the outer conductor, d is the outside diameter of the inner conductor, and e is the dielectric constant of the material between the conductors. For the connector front portion 12, it was not possible to change the characteristic impedance by changing the diameters of the conductors, since it is a fixed design for engaging mating connectors of a predetermined size. However, applicant's substitution of primarily air for a solid material such as Teflon (dielectric constant of 2.55) increases the characteristic impedance to more closely match the desired level.

The dielectric support has a middle portion 72 which could be all solid dielectric material. However, applicant prefers to form even the middle portion 72 primarily of air, to enable an increase in the diameter D of the middle portion so it is closer to the diameter F of the front portion of the inner conductor. By reducing the differences in diameters D, F, applicant reduces reflections that can lead to increased losses at higher frequencies (above about 750 MHz), although the losses due to reflections is secondary compared to the losses due to the previously greatly unmatched impedances. Applicant's connector is now used primarily for frequencies of up to about 2 GHz where the later is true. As shown in FIG. 6, the middle portion 72 of the dielectric support includes three rods 74A, 74B, and 74C, which together occupy about 20% of the cross-sectional area between the middle and rear locating portions 62, 64 (FIG. 3), except for a center flange 76 which provides a shoulder for the outer conductor tab 40.

It is noted that in FIGS. 5 and 6, there are only three rods spaced 90° apart, with a gap 80, 82 of about 180° between two of the rods. This construction aids in constructing the support by forming it as a one-piece plastic molded part. The three rods such as 66A, 66B, and 66C can be withdrawn from a mold more easily than if the gap was less than about 180°. The vertical sides such as 84, 86 of the posts are parallel to also ease in removal from a mold.

Applicant has constructed and tested a connector of the above design, and one of the previous design (front socket end to receive a 1 mm pin, with a front outer diameter of about 3.7 mm). For an external impedance of 68.8 ohms and a frequency of 1000 MHz and no load, the previous design (space between conductors filled with solid dielectric) resulted in a VSWR of 1.145 while the new design described above produced a VSWR of 1.087. When a load was connected, the previous design produced a VSWR of 1.132 while the new design produced a VSWR of 1.081.

Thus, the invention provides a coaxial connector of the type wherein the front end of the inner conductor forms a socket for receiving a pin of predetermined size and the outer conductor has a smaller diameter at its front portion than at its middle, which enables an increase in the characteristic impedance of the front portion of the connector. This is accomplished by providing primarily air as the dielectric that lies between the inner and outer conductors at the front portion of the connector. The dielectric can be formed by a dielectric support which preferably has a front locating part that forms a lead-in to the socket and that is connected by axially-extending rods to a ring-shaped mid locating part at the front of connector middle portion. The support preferably includes a rear ring-shaped locating part that is connected to the mid locating part by a plurality of rods, so there is primarily air in the space at the middle portion of the connector to allow a larger diameter inner conductor at the middle of the connector for lower reflections. The connector design is especially useful for a particular connector design where the socket contact at the front of the inner conductor is designed to receive a pin of 1 mm diameter and the outside of the front portion has a diameter of about 3.7 mm. Although a nonporous solid dielectric is shown for the support, it would be possible to use a rigid foam that fills the entire space but with a gas such as air occupying most of the foam volume.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A coaxial connector which includes an inner electrical conductor extending along a connector axis, an outer electrical conductor surrounding said inner conductor with an annular space between them, wherein said outer conductor has a front portion of a first outside diameter and a middle portion of a larger second outside diameter that is more than 20% greater than said first diameter, where said inner conductor has a front end that forms a socket of predetermined size for receiving a pin of predetermined diameter, and where said annular space includes a front space portion lying within said outer conductor front portion and a middle space portion lying within said outer conductor middle portion, including:

a dielectric support of solid dielectric material which lies in said front and middle spaces and which has a first portion that supports said inner conductor within said outer conductor, said dielectric support including a front dielectric portion which lies within said front space portion and that forms a lead-in lying forward of the front end of said socket of said inner conductor, with said dielectric support including a connecting part that connects said first portion and said front dielectric portion with said connecting part occupying less than half of the volume of said front space portion, and with the rest of the volume of said front space portion being occupied by air.

2. Apparatus for use in a coaxial connector that has an axis, to support an inner conductor within an outer conductor, where the outer conductor has a front portion of a first average inside diameter and a middle portion of a second average inside diameter that is larger than said first inside diameter, and where the inner conductor has a front portion of a first average outside diameter and a middle portion of a second average outside diameter, comprising:

a molded dielectric support having a plurality of axially-spaced locating parts that are each constructed to engage both said inner conductor and said outer conductor, to center said inner conductor within said outer conductor;

said support also including a connecting portion that connects said axially-spaced location parts, said connecting portion comprising at least one primarily axially-extending post, with said connecting portion occupying an average of less than one-third of the cross-sectional areas of the space between said inner and outer conductors and being out of close contact with at least one of said conductors.

3. The apparatus described in claim 2 wherein:

said plurality of posts includes three posts spaced about 90° apart about said axis, with a gap of about 180° between two of said posts.

4. The support described in claim 2 wherein:

said at least one post comprises a plurality of parallel circumferentially spaced posts that are each out of contact with both said outer conductor and said inner conductor.

5. A coaxial plug connector with front and middle portions, said connector having an outer conductor that has a front portion at said connector front portion with said outer conductor front portion having an outside diameter of less than 3.9 mm and an outer conductor middle portion with an outside diameter of more than 4.1 mm, said connector having an inner conductor with a front portion at said connector front portion with said inner conductor forming a socket with a plurality of tines for receiving a pin of 1 mm diameter, and with said inner conductor having a middle portion lying rearward of said front portion and within said outer conductor middle portion, with said connector having a dielectric spacer that has a first portion that engages said inner conductor middle portion and said outer conductor to fix the radial position of said inner conductor within said outer conductor and that has a second portion that forms a lead-in forward of said socket to guide said pin into said socket, where the characteristic impedance of said connector middle portion is about 50 ohms, and where the characteristic impedance of said front portion is less than 35 ohms when the front space between said conductor front portions is completely filled with a solid dielectric having a dielectric constant of 2.55, wherein:

said dielectric spacer includes a part that connects said first and second portions and that occupies no more than one-third of the volume of said front space with the rest of said front space comprising air, with the characteristic impedance of said front portion being more than 10 ohms higher than it would be if it were completely filled with said solid dielectric.

6. A coaxial connector which includes an inner electrical conductor extending along a connector axis, an outer electrical conductor surrounding said inner conductor with an annular space between them, wherein said outer conductor has a front portion of a first outside diameter and a middle portion of a larger second outside diameter that is more than 20% greater than said first diameter, wherein said inner conductor has a front end that forms a socket of predetermined size for receiving a pin of predetermined diameter, and where said annular space includes a front space portion lying within said outer conductor front portion and a middle space portion lying within said outer conductor middle portion, including:

a dielectric support of solid dielectric material which lies in said space and which has a portion that supports said inner conductor within said outer conductor, said dielectric support including a front portion which lies within said front space portion and that forms a lead-in lying forward of the front end of said socket of said inner conductor, with said front support portion occupying less than half of the volume of said front space portion, and with the rest of the volume of said front space portion being occupied by air;

said front support portion has a front end forming a front ring that engages the inside of said outer conductor front portion and that forms said lead-in, said support includes a middle support that has a mid ring that engages the inside of said outer conductor middle portion and said inner conductor, and a connecting part that connects said front ring and said mid ring;

said connecting part including at least one axially-extending rod that is out of engagement with said inner and outer conductors.

7. A coaxial connector which includes an inner electrical conductor extending along a connector axis, an outer electrical conductor surrounding said inner conductor with an annular space between them, wherein said outer conductor has a front portion of a first outside diameter and a middle portion of a larger second outside diameter that is more than 20% greater than said first diameter, where said inner conductor has a front end that forms a socket of predetermined size for receiving a pin of predetermined diameter, and where said annular space includes a front space portion lying within said outer conductor middle portion, including:

a dielectric support of solid dielectric material which lies in said space and which has a portion that supports said inner conductor within said outer conductor, said dielectric support including a front portion which lies within said front space portion and that forms a lead-in lying forward of the front end of said socket of said inner conductor, with said front support portion occupying less than half of the volume of said front space portion, and with the rest of the volume of said front space portion being occupied by air;

said dielectric support includes a front ring which lies closely within a front end of said outer conductor front portion and that forms said lead-in, a mid ring which lies closely within a front end of said outer conductor mid portion, a rear ring which lies closely within a said outer conductor and rearward of said mid ring, and a connecting part which connects said rings including a plurality of rods that extend parallel to said axis by that are out of close contact with said inner and outer contacts.

8. The coaxial connector described in claim 7 wherein:

said inner conductor front portion forms a plurality of tines with rear ends, said mid ring lies closely around said inner conductor at a location immediately behind said tine rear ends, said inner conductor forms a rearwardly-facing shoulder abutting said mid ring, sand said inner conductor forms a forwardly-facing shoulder abutting said rear ring.

* * * * *